United States Patent [19]

Nishijima et al.

[11] Patent Number: 4,526,853

[45] Date of Patent: Jul. 2, 1985

[54] METHOD OF PROVIDING AN INCREASED BRIGHTENING EFFECT AND SILVER HALIDE PHOTOGRAPHIC MATERIAL HAVING INCREASED BRIGHTENING EFFECT

[75] Inventors: Toyoki Nishijima; Masao Sasaki; Kaoru Onodera, all of Odawara, Japan

[73] Assignee: Konishiroku Photo Industry Co., Ltd., Tokyo, Japan

[21] Appl. No.: 541,973

[22] Filed: Oct. 14, 1983

[30] Foreign Application Priority Data

Oct. 15, 1982 [JP] Japan ..... 57-180939
Oct. 18, 1982 [JP] Japan ..... 57-182611

[51] Int. Cl.[3] ..... G03C 5/14

[52] U.S. Cl. ..... 430/139; 430/512; 430/527; 430/933

[58] Field of Search ..... 430/139, 512, 933, 527

[56] References Cited

U.S. PATENT DOCUMENTS 3,269,840 8/1966 Pattyn et al. ..... 430/139
3,666,470 5/1972 Tsuji et al. ..... 430/139
4,072,624 2/1978 Croome et al. ..... 430/139
4,115,124 9/1978 Hamilton et al. ..... 430/933

*Primary Examiner*—J. Travis Brown
*Attorney, Agent, or Firm*—Finnegan, Henderson, Farabow, Garrett and Dunner

[57] ABSTRACT

A silver halide color photographic material having improved whiteness and a method of processing said material are disclosed. The material is formed on a hydrophobic support at least one silver halide emulsion layer, a layer containing a brightening agent and a layer containing a compound that is capable of trapping the brightening agent, said layer containing a compound capable of trapping the brightening agent being separate from the layer containing the brightening agent and positioned more remote from the support than the latter layer, and also, the method for providing enhanced brightening effect comprises subjecting said material to imagewise exposure and color development so that said brightening agent is diffused into and trapped by the layer containing capable of trapping the brightening agent.

13 Claims, No Drawings

METHOD OF PROVIDING AN INCREASED BRIGHTENING EFFECT AND SILVER HALIDE PHOTOGRAPHIC MATERIAL HAVING INCREASED BRIGHTENING EFFECT

BACKGROUND OF THE INVENTION

1. Field of the Invention

The present invention relates to a silver halide color photographic material adapted to direct viewing and a method of processing said material. More particularly, the invention relates to a silver halide color photographic material having improved whiteness and no chance of forming static marks, as well as to a method of processing such a material.

2. Description of the Prior Art

The whiteness of the background has an important effect on the image formed in photographic materials for direct viewing. An improved whiteness of the background increases the contrast, color saturation and aesthetic appeal of the image. Several methods have been proposed for increasing the background whiteness. Brightening agents are known as one effective means for increasing the whiteness of silver halide photographic materials. In one conventional method, the brightening agents are contained in one of the solutions employed in color processing, as shown in Japanese Patent Publications Nos. 35240/71, 20975/74 and 25336/75. However, the methods described in these patents are defective in one way or another; they do not provide adequately high brightening effects, or the developing solution used has decreased stability. Therefore, these methods are not adaptive to the recent demand for processing a wide variety of photographic materials at faster speeds.

In another method, the brightening agent is contained within the photographic material per se, as described in Japanese Patent Publications Nos. 21189/71, 27692/73, 10696/74, 28225/76 and 32254/77. The brightening agent used in this manner provides an enhanced intensity of fluorescence, so the whiteness of the unexposed area is improved over that achieved by the first method. However, even this second method has its own defect because of the fact that the brightening agent is incorporated in one of the layers of the photographic material (e.g. subbing layer, emulsion or non-emulsion layers) either alone or in combination with a compound that traps the brightening agent to increase its brightening ability. A typical defect is static marks that develop during the manufacture or processing of photographic materials, for example, when coating respective layers onto the support at high speed, transporting the photographic material through a color printer, or when peeling an adhesive tape from the photographic material before use. The greater the intensity of fluorescence, the greater the chance of the occurrence of static marks, and there is no conventional method to satisfy the two objects at the same time, i.e. increasing the whiteness of the background and preventing the formation of static marks. Static marks are most likely to occur in photographic materials of the type that uses a hydrophobic support such as polyolefin-coated paper.

SUMMARY OF THE INVENTION

The present invention has been accomplished in order to eliminate these defects of the conventional silver halide color photographic materials. One object of the invention is to provide a silver halide color photographic material having improved whiteness in the background and which is effectively protected against static marks without sacrificing the sensitivity.

Another object of the present invention is to provide a silver halide color photographic material having improved whiteness in the background without color staining.

Still another object of the present invention is to provide a silver halide color photographic material ensuring high fidelity in color reproduction.

A further object of the present invention is to provide a novel method for processing a silver halide color photographic material, by which the whiteness of the background is improved and the occurrence of static marks is prevented.

The first to three objects of the present invention can be achieved by a silver halide color photographic material having formed on a hydrophobic support at least one silver halide emulsion layer, a layer containing a brightening agent and a layer containing a compound that traps the brightening agent, said layer containing a compound that traps the brightening agent being separate from the layer containing the brightening agent and positioned more remote from the support than the latter layer.

The fourth object of the present invention can be achieved by a method wherein the novel silver halide color photographic material described above is subjected to imagewise exposure and color development so that the effectiveness of the brightening agent is increased by causing it to be diffused into and trapped by the compound capable of its trapping.

DETAILED DESCRIPTION OF THE PREFERRED EMBODIMENTS

Examples of the brightening agent that can be used in the present invention include diaminostilbene, benzidine, imidazole, triazole and imidazolone compounds. Preferred examples are water-soluble brightening agents having in the molecule at least one organic acid group with a pKa of 6.0 or less, or at least one organic base with a pKb of 7.5 or less. More preferred are water-soluble brightening agents having in the molecule at least one organic acid group with a pKa of 5.0 or less or at least one organic base with a pKb in the range of 4.0 to 7.5. Most preferred are water-soluble brighteners having in the same molecule at least one organic acid group with a pKa of 5.0 or less and at least one organic base with a pKb in the range of 4.0 to 7.5. It is most preferred that the organic base have a pKb in the range of 4.0 to 7.0.

The symbol pKa as used herein means the dissociation or ionization constant of acids which is one measure of their strength. The exact definition of pKa is given in, for example, "Chemical Handbook (Fundamentals II)", The Chemical Society of Japan, p. 1053. The dissociation of an acid HA is shown by the equation $HA \rightleftarrows H^+ + A^-$. The dissociation constant Ka is shown by $Ka = [H^+][A^-]/[HA]$ and pKa is shown by $pKa = -\log Ka$. The symbol pKb represents the ionization constant of bases. When the dissociation of a base B is shown by the equation $B + H_2O \rightleftarrows BH^+ + OH^-$, the dissociation constant Kb is shown by $Kb = [BH^+][OH^-]/[B]$, with pKb shown by $pKb = -\log Kb$.

Preferred brightening agents are hereunder listed together with their formulas.

Diaminostilbene compounds:

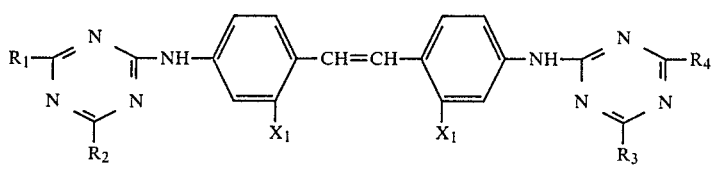

(I)

wherein $R_1$, $R_2$, $R_3$ and $R_4$ each represent a hydrogen atom, a halogen atom, a sulfonic acid or salt thereof, a carboxylic acid or a salt thereof, an alkylamino group, an arylamino group, a hydroxyl group, an amino group, an alkoxyl group, an aryloxy group or a morpholino group; $X_1$ is a sulfonic acid or a carboxylic acid or a salt thereof.

Benzidine compounds:

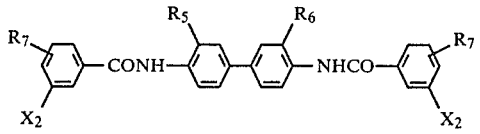

(II)

wherein $R_5$, $R_6$ and $R_7$ are each a hydrogen atom, a hydroxyl group, and alkyl group or an alkoxyl group; $X_2$ is a sulfonic acid or a carboxylic acid or a salt thereof; with a hydroxyl group being particularly preferred as $R_7$.

Imidazole compounds:

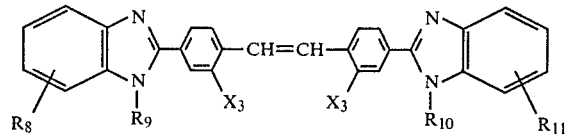

(III)

wherein $R_8$ and $R_{11}$ are each a hydrogen atom, an alkyl group, an alkoxy group or a sulfonic acid or a salt thereof; $R_9$ and $R_{10}$ are each a hydrogen atom, an alkyl group, or a hydroxy-alkyl group; $X_3$ is a sulfonic acid, a carboxylic acid or a salt thereof.

Triazole compounds:

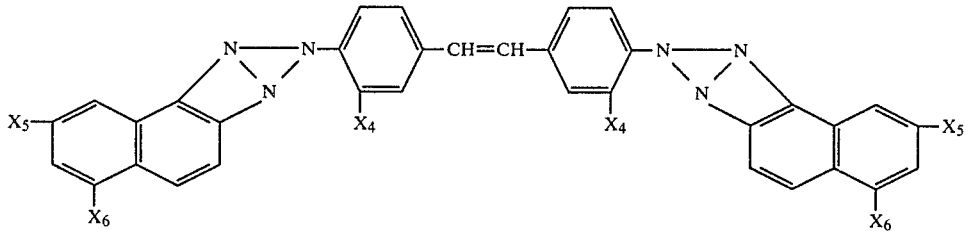

(IV)

wherein $X_4$ and $X_5$ are each a hydrogen atom, or a carboxylic acid or a sulfonic acid or a salt thereof; $X_6$ is a sulfonic acid or carboxylic acid or a salt thereof.

Specific examples of the brightening agent according to the present invention which may or may not be represented by formulas (I) to (IV) are listed below.

Diaminostilbene compounds:

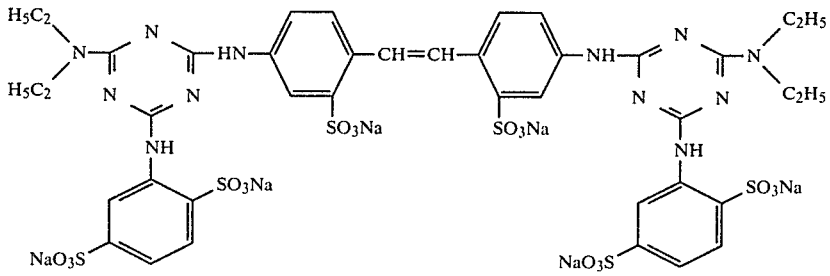

FB-1

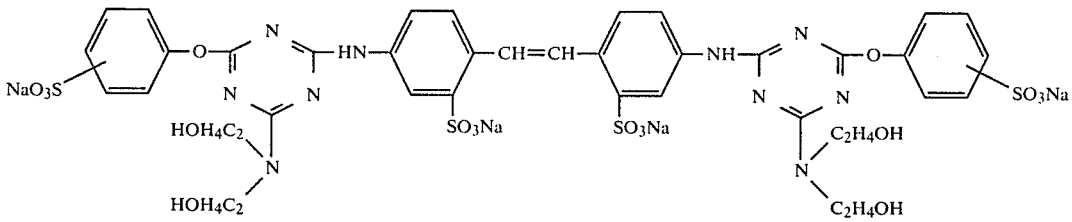

FB-2

-continued

FB-3

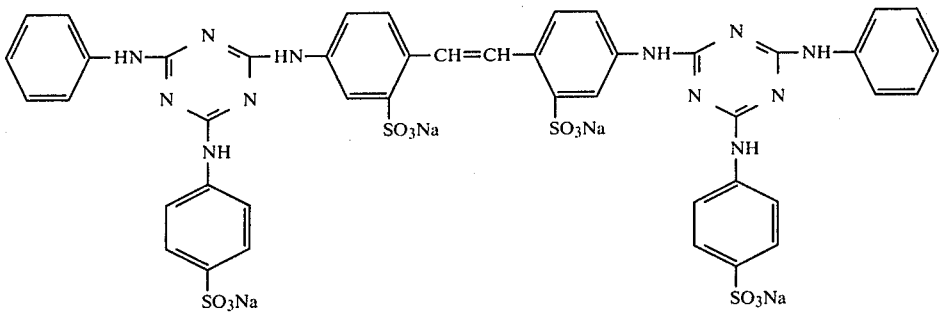

FB-4

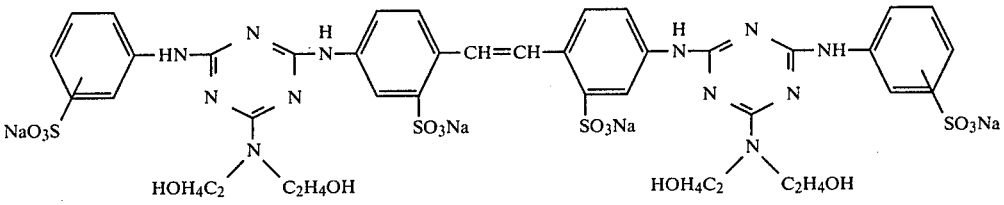

Benzidine compound:

FB-5

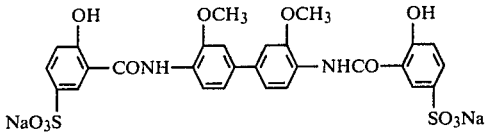

Imidazole compound:

FB-6

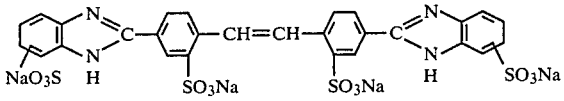

Triazole compounds:

FB-7

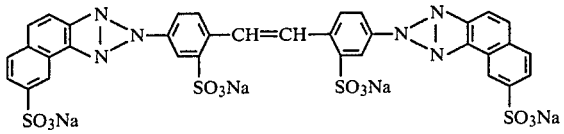

Other compounds:

FB-8

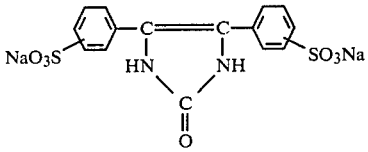

FB-9

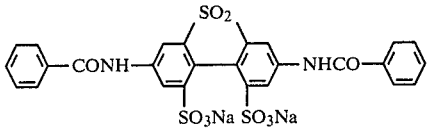

-continued

FB-10

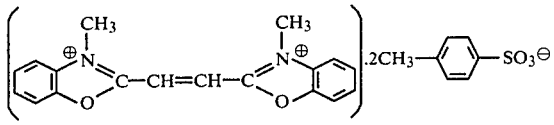

The layer containing the brightening agent according to the present invention is separate from the layer that contains the compound capable of trapping said brightening agent, and the former is closer to the hydrophobic support than the latter layer. The brightening agent may be incorporated in any layers that are positioned closer to the hydrophobic support than the layer containing the compound capable of trapping the brightener; therefore, the brightener may be incorporated in any of the silver halide emulsion layers. However, some brightening agents, when they are incorporated in one of the silver halide emulsion layers, may have adverse effects on the preservability of the raw material, sensitivity, gradation and anti-fog properties of the photographic material. Therefore, preferably, the brightening agent according to the present invention is incorporated in a non-emulsion layer that is positioned closer to the support than the layer containing the compound capable of trapping the brightener. Suitable non-emulsion layers in which the brightening agent may be incorporated are a layer between a blue-sensitive silver halide emulsion layer and a green-sensitive silver halide emulsion layer and a layer positioned between green-sensitive and red-sensitive emulsion layers.

For achieving a greater improvement in whiteness, the brightening agent may be contained in a layer which is the closest to the layer containing the compound capable of trapping the brightener. Therefore, it is particularly preferred that the brightener be incorporated in one of the non-emulsion layers that are closer to the hydrophobic support than the layer containing the compound capable of trapping the brightener and which is the closest to the latter layer. For example, the brightening agent may be incorporated in a layer between green-sensitive and red-sensitive silver halide emulsion layers.

The silver halide color photographic material according to the present invention may also include one or more layers containing a UV absorber. Even in this case, the layer containing the brightening agent is separate from the layer containing the compound capable of trapping the brightener. The brightening agent may be incorporated in any layers that are positioned closer to the hydrophobic support than the UV absorber containing layer that is positioned the remotest from the hydrophobic support. If desired, the brightener may be incorporated in one of the silver halide emulsion layers. As in the case where no layer contains the UV absorber, some brightening agents, when they are incorporated in one of the silver halide emulsion layers, may have adverse effects on the preservability of the raw material, sensitivity, gradation and anti-fog properties of the photographic material. Therefore, the brightening agent is preferably incorporated in a non-emulsion layer that is closer to the support than a UV absorber containing layer positioned the remotest from the support.

For example, when the hydrophobic support has successively formed thereon blue-sensitive, green-sensitive, and red-sensitive silver halide emulsion layers, and if a layer containing the UV absorber is disposed between the red-sensitive silver halide emulsion layer and a protective layer, the brightening agent is preferably contained in a layer between the blue-sensitive and red-sensitive silver halide emulsion layers and/or a layer between the green-sensitive and red-sensitive silver halide emulsion layers. For achieving a greater improvement in whiteness, the brightening agent is preferably contained in a layer which is the closest to the layer containing the compound capable of trapping the brightener. Therefore, it is particularly preferred that the brightener be incorporated in one of the non-emulsion layers that are closer to the support than the UV absorber containing layer positioned the remotest from the support and which is the closest to the layer containing the compound capable of trapping the brightener. For example, the brightener is most preferably contained in a layer between green-sensitive and red-sensitive silver halide emulsion layers.

An amount of the brightening agent that is small enough to substantially preclude the occurrence of static marks may be incorporated in the layer containing the compound capable of trapping the brightener, or the UV absorber containing layer positioned the remotest from the support, and/or the layer which is more remote from the support than said UV absorber containing layer.

The brightening agent according to the present invention is usually deposited in a thickness of 0.1 to 0.5 $mg/dm^2$.

The layer containing the brightening agent may use various known hydrophilic binders. Preferred hydrophilic binders are those having an organic acid group with a pKa of 6.0 or less or an organic base with a pKb of 7.5 or less, and those having an organic acid with a pKa of 6.0 or less and an organic base with a pKb of 7.5 or less are particularly preferred. Hydrophilic polymers such as gelatin having an isoelectric point between 4.5 and 8.0 are most preferred.

Many known compounds can be used as the compound that entraps the brightening agent and enhances its brightening effect (this compound is hereunder sometimes referred to as a trapping agent). Particularly useful compounds are hydrophilic polymers, such as polyvinylpyrrolidone and polymers having vinylpyrrolidone as a repeating unit. Examples of the monomer forming a repeating unit together with vinylpyrrolidone include acrylic acid, methacrylic acid, acrylic acid amides and methacrylic acid amides (such as acrylamide, methacrylamide, N,N-dimethylacrylamide, N,N-diethylacrylamide, N-methylolacrylamide, N-hydroxyethylacrylamide, N-tert-butylacrylamide, N-cyclohexylacrylamide, diacetoneacrylamide, N-(1,1-dimethyl-3-hydroxybutyl)acrylamide, N-(β-morpholino)ethylacrylamide, N-benzylacrylamide, N-acryloylmorpholine, N-methacryloylmorpholine, N-methyl-N'-acryloylpiperazine, N-acryloylpiperidine, N-acryloylpyrrolidine, and N-acryloylhexamethyleneimine), alkyl esters of acrylic acid and methacrylic acid (such as methyl methacrylate, ethyl acrylate, hydroxyethyl acrylate, propyl acrylate, cyclohexyl acrylate, 2-ethylhexyl acrylate, decyl acrylate, β-cyanoethyl acrylate, β-chloroethyl acrylate, 2-ethoxyethyl acrylate and sulfopropyl methacrylate), vinyl esters (e.g. vinyl acetate, vinyl propionate, vinyl butyrate and vinyl lactate), vinyl ethers (e.g. methyl vinyl ether, butyl vinyl ether, and oleylvinyl ether), vinyl ketones (e.g. methyl vinyl ketone and ethyl vinyl ketone), styrenes (e.g. styrene, methylstyrene, dimethylstyrene, 2,4,6-trimethylstyrene, ethylstyrene, laurylstyrene, chlorostyrene, dichlorostyrene, methoxystyrene, cyanostyrene, dimethylaminostyrene, chloromethylstyrene, vinylbenzoic acid, styrenesulfonic acid and α-methylstyrene), vinyl hetero cyclic compounds (e.g. vinylpyridine, vinylpyrrolidone, vinylisoxazoline, and vinylimidazole), acrylonitrile, vinyl chloride, vinylidene chloride, ethylene, propylene, butadiene, isoprene, chloroprene, maleic anhydride, maleic itaconic acid, citraconic anhydride and vinylsulfonic acid. Other preferred compounds include the poly-N-vinyl-5-methyl-2-oxazolidinone and the polymer of N-vinylamide compounds represented by $CH_2=CHNR_1COR_2$ as described in Japanese Patent Publication No. 31842/73, the hydrophilic polymer containing a cationic nitrogen-containing active group as described in Japanese Patent Application (OPI) No. 42723/73 (the symbol OPI as used herein means an unexamined published Japanese patent application), the N-morpholinoalkylalkenoylamide polymer described in Japanese Patent Publication No. 2522/69, the vinyl alcohol and vinylpyrrolidone copolymer described in Japanese Patent Publication No. 20738/72, the polymer described in Japanese Patent Publication No. 49028/72 which has the formula

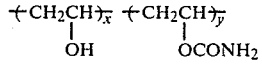

($x+y=100$–$500$, $y/x+y=0.05$–$0.25$), and the polymer described in Japanese Patent Publication No. 38417/73 having the formula:

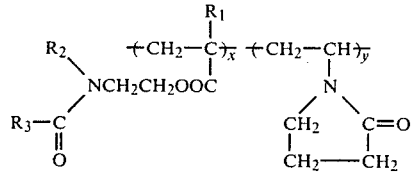

(wherein $R_1$ is —H or $—CH_3$; $R_2$ is —H, $—CH_3$, $—C_2H_5$, $—C_3H_7$, $—C_4H_9$; $R_3$ is —H, $—CH_3$, $—C_2H_5$, $—C_3H_7$, $—C_4H_9$; $x/y=95/5$–$20/80$). Particularly preferred compounds are polyvinylpyrrolidone and its copolymers.

The hydrophilic polymers listed above have a weight average molecular weight of 1,000 or greater, preferably 10,000 or greater, more preferably, from 50,000 to 1,000,000. These trapping agents are incorporated in a layer separate from the layer containing the brightening agent and is more remote from the support than the latter.

When a UV absorber containing layer is used, the trapping agent is incorporated in a layer separate from the layer containing the brightening agent. Specifically, the trapping agent is incorporated in the UV absorber containing layer positioned the remotest from the support, and/or a layer positioned more remote from the support than the UV absorber containing layer which is the remotest from the support. The more the trapping agent that is used, the more the brightening agent that is trapped and the greater the improvement in whiteness. However, if the trapping agent is contained in a protective layer that is the most remote from the support and if the content of the trapping agent is more than 2% of the hydrophilic binder in the protective layer, the physical properties of the protective layer are impaired and other serious defects such as reticulation occur. Therefore, the trapping agent is preferably incorporated in a layer between the protective layer and the emulsion layer which is the remotest from the support. The trapping agent is usually deposited in a thickness of 0.05 to 3.0 mg/dm$^2$.

According to the present invention, the UV absorber may be incorporated in one or more layers. In the latter case, one of the UV absorber containing layers that is the most remote from the hydrophobic support may be arranged together with the layer containing the brightening agent and the layer containing the trapping agent in the order described above. Suitable UV absorbers that can be used in the present invention are benzotriazole compounds of formula V:

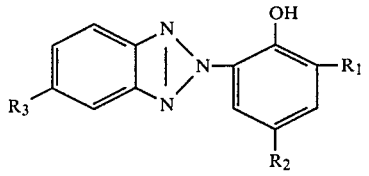

(V)

wherein $R_1$, $R_2$ and $R_3$ are each a hydrogen atom, a halogen atom, an alkyl group, an aryl group, an alkoxy group, an aryloxy group, an alkenyl group, a nitro group and a hydroxyl group.

Typical UV absorbers of formula V are listed below.

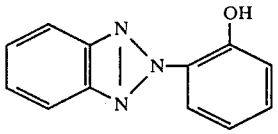

UV-1

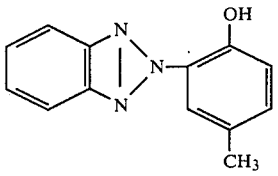

UV-2

-continued

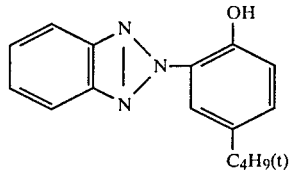

UV-3

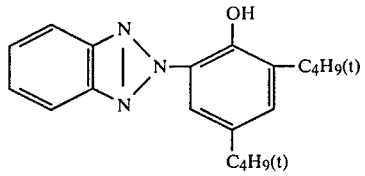

UV-4

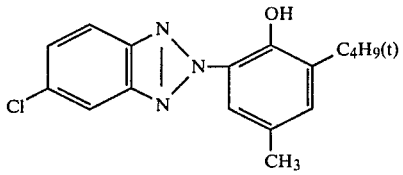

UV-5

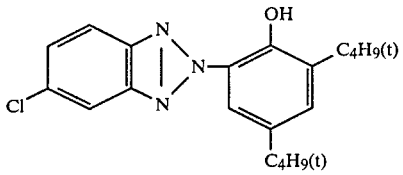

UV-6

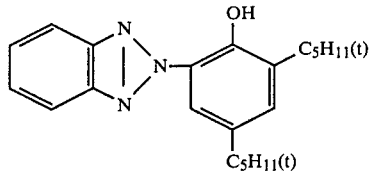

UV-7

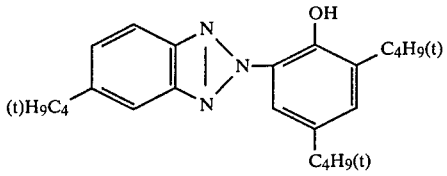

UV-8

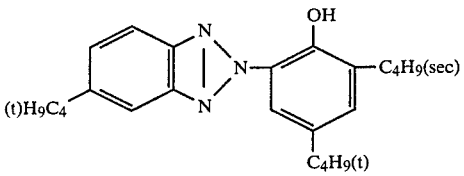

UV-9

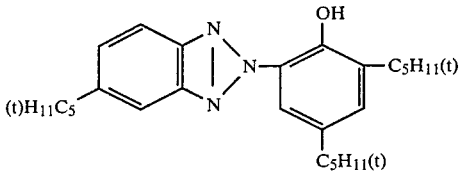

UV-10

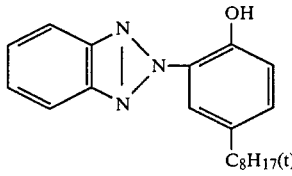

UV-11

-continued

UV-12

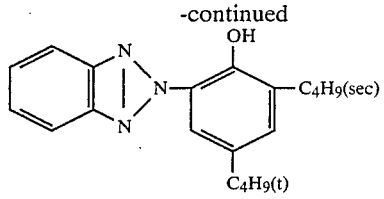

UV-13

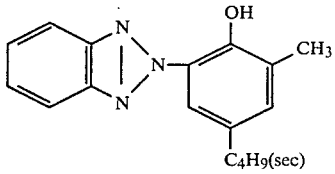

UV-14

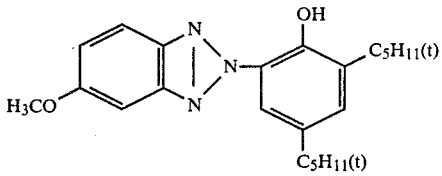

UV-15

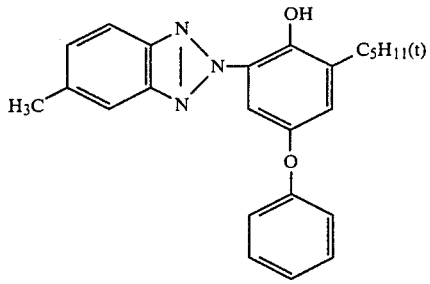

UV-16

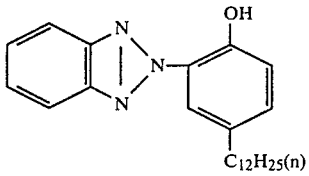

UV-17

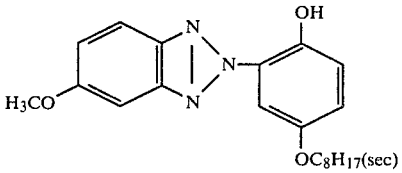

UV-18

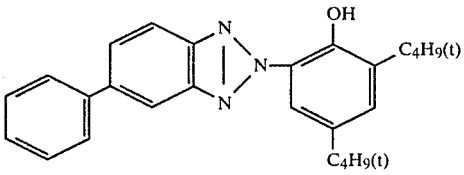

UV-19

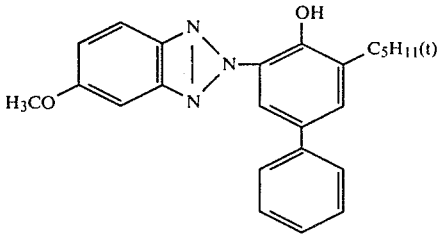

These benzotriazole compounds can be readily synthesized by any of the methods described in Japanese Patent Publications Nos. 10466/61, 26187/67, 5496/73 and 41572/73, as well as U.S. Pat. Nos. 3,754,919 and 4,220,711. These UV absorbers are used in an amount of 0.001 to 2 parts by weight per part by weight of the hydrophilic binder contained in the layer in which those absorbers are incorporated.

The silver halide color photographic material of the present invention having the above described layer arrangement is then subjected to the following color processing. First, the material is subjected to image-wise exposure and developed with a color-developing solution containing a color-developing agent. Alternatively, a silver halide color photographic material containing a color-developing agent or its precursor is first exposed and then processed with an "activator" solution. If necessary, the color development may be preceded by a black-and-white development. After completion of the color development, the photographic material is usually bleach-fixed and washed with water by the conventional procedure. The color development with the color-developing solution or the activator solution may be effected independently of each of the bleach-fixing and washing steps. However, it is also possible to accomplish two or more of these steps at one time by a single bath. According to the present invention, the color processing includes the steps of color development, bleach-fixing and washing, and at least one of the solutions used in these steps is preferably more alkaline than pH 9.

Typical color-developing agents are aromatic primary amine compounds such as aminophenol derivatives and p-phenylenediamine derivatives. These compounds can be used either in the free state or as their inorganic acid salts such as hydrochlorides and sulfates, or as organic acid salts such as p-toluenesulfonates, tetraphenyl borates and p-(1-octyl)benzenesulfonates. Illustrative aromatic primary amine compounds suitable as the color-developing agent include o-aminophenol, p-aminophenol, 5-amino-2-oxytoluene, 2-amino-3-oxytoluene, 2-oxy-3-amino-1,4-dimethylbenzene, N,N-diethyl-p-phenylenediamine hydrochloride, N-methyl-p-phenylenediamine hydrochloride, N,N-dimethyl-p-phenylenediamine hydrochloride, N-ethyl-N-$\beta$-methanesulfonaminoethyl-3-methyl-4aminoanline and sulfate salts thereof, N-ethyl-N-$\beta$-hydroxyethylaminoaniline, N,N-diethyl-3-($\beta$-methanesulfonamidoethyl)-4-aminoaniline hydrochloride, 4-amino-N-(2-methoxyethyl)-N-ethyl-3-methylaniline-p-toluenesulfonate, N-ethyl-N-$\beta$-methanesulfonamidoethyl-3-methyl-4-aminoaniline tetraphenyl borate, 4-amino-N-(2-methoxydiethyl)-N-ethyl-3-methylaniline tetraphenyl borate, p-morpholinoaniline, p-piperidinoaniline and 4-amino-N,N-diethyl-3-chloroaniline.

The precursor for the color-developing agent incorporated in the silver halide color photographic material is a compound capable of forming the color-developing agent under alkaline conditions. Illustrative precursors include Schiff bases with aromatic aldehyde derivatives, polyvalent metallic ion complexes, phthalic acid imide derivatives, phosphoric acid amide derivatives, sugar-amine reaction products and urethane compounds. Illustrative precursors for the aromatic primary amine color-developing agents are described in U.S. Pat. Nos. 3,342,599, 2,507,114, 2,965,234, 3,719,492, British Patent No. 803,783, Japanese Patent Application (OPI) Nos. 135628/78 and 79035/79, as well as Research Disclosure Nos. 15159, 12146 and 13924.

The aromatic primary amine color-developing agents are usually contained in the color-developing solution in an amount of about 1 to 20 g/l. If they are used as precursors, their content may range from about 0.5 to 3 mols per mol of the silver halide.

The color-developing solution or activator solution used in the present invention may contain alkali agents such as potassium hydroxide, sodium hydroxide, sodium carbonate, potassium carbonate, sodium tertiary phosphate and potassium tertiary phosphate; sulfites such as sodium sulfite and potassium sulfite; and bromides such as sodium bromide, potassium bromide and ammonium bromide. The color-developing solution and activator solution may further contain known development retarders; thiocyanates such as sodium thiocyanate, potassium thiocyanate and ammonium thiocyanate; chlorides such as ammonium chloride, potassium chloride and sodium chloride; organic solvents such as ethylene glycol, diethylene glycol, methanol, ethanol, n-butanol, benzyl alcohol, acetone and dimethylformamide; amines such as hydroxylamine, ethanolamine, ethylenediamine and diethanolamine; water softeners such as sodium hexametaphosphate, sodium tripolyphosphate, ethylenediaminetetraacetic acid and diethylenetriaminetetraacetic acid; and water-soluble brightening agents.

The color-developing solution or activator solution used in the present invention may also contain auxiliary developing agents. Preferred auxiliary developing agents are 1-aryl-3-pyrazolidone derivatives and may be used in an amount of 1 mg to 1 g, preferably 10 mg to 500 mg, per liter of the color-developing solution or activator solution. Typical auxiliary developing agents include 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidione and 4-methyl-4-hydroxymethyl-1-(p-tolyl)-3-pyrazolidone.

The color-developing agent and activator solution according to the present invention is generally used within a certain range of temperatures, which depends on the type of the photographic material to be processed, its composition, use and object. The preferred range is from 15° to 70° C., and the range of 30° to 50° C. is more preferred.

Known compounds can be used as the bleaching agent to be incorporated in the bleach-fixing bath. Suitable examples are aminopolycarboxylic acid ferric complex salts such as ethylenediaminetetraacetic acid ferric sodium salt and ethylenediaminetetraacetic acid ferric ammonium; and persulfate salts such as ammonium persulfate and sodium persulfate. Known compounds can be used as the fixing agent to be incorporated in the bleach-fixing bath. Suitable examples are thiosulfate salts such as sodium thiosulfate and ammonium thiosulfate; water-soluble sulfur-containing diols such as 3,6-dithia-1,8-octanediol and 3,6,9,12-tetrathia-1,14-tetradecanediol; and water-soluble sulfur-containing dibasic acids such as ethylene-bis-thioglycolic acid, its sodium salt, and 3,6,9-trithiahendecanedioic acid.

The silver halide color photographic material that can be processed by the present invention is applicable to any type that has a hydrophobic support.

Photographic materials such as color printing paper that permits direct viewing by reflected light, and color slides that enable direct viewing by projection onto screens are preferred. The process of the present invention is particularly effective when it is applied to color printing paper. The color printing paper usually has three types of photosensitive silver halide emulsion layers with different spectral sensitivities which respectively contain non-diffusing yellow, magenta and cyan couplers. Common combinations of silver halide emulsion layers and couplers are such that a red-sensitive silver halide emulsion layer is combined with a cyan coupler, a green-sensitive silver halide emulsion layer with a magenta coupler, and a blue-sensitive silver halide emulsion layer with a yellow coupler. There is no particular limitation on the order in which the three emulsion layers are arranged. However, in the color printing paper to which the process of the present invention is applied advantageously, the hydrophobic support is usually over-laid successively with a yellow coupler containing layer, a magenta coupler containing layer and a cyan coupler containing layer, or in the order of a cyan coupler containing layer, a magenta coupler containing layer and a yellow coupler containing layer.

Any known compounds may be used as yellow, magenta and cyan couplers in the present invention. Preferred yellow couplers are α-pivaloyl acetanilide compounds. Preferred magenta couplers are 1-phenyl-3-anilino-5-pyrazolone compounds and pyrazolotriazole compounds. Preferred cyan couplers are phenol compounds. Each of these couplers may be incorporated in the spesific silver halide emulsion layer in an amount of about 0.05 to 1 mol per mol of the silver halide.

In addition to the silver halide emulsion layers described above, the silver halide photographic material according to the present invention may have formed on the hydrophobic support non-sensitive layers such as protective layers, intermediate layers, filter layers and scavenger layers. These non-sensitive layers may be arranged in any order and in any number. The binder in these non-sensitive layers is deposited in an amount which usually ranges from about 1 to 30 mg/dm$^2$ per layer.

Examples of the hydrophobic support that can be used in the present invention include polyolefin-coated paper, plastics such as polyolefins (e.g. polypropylene), celluloses (e.g. triacetyl cellulose) and polyesters (e.g. polyethylene terephthalate), and glass.

The non-diffusing couplers listed above may be dispersed in the silver halide color photographic material of the present invention by various methods such as dispersion in aqueous alkalies, dispersion in solid form, dispersion in latices, and oil-in-water emulsification. A suitable method may be selected depending upon the chemical structure of the specific non-diffusing coupler. For the purposes of the present invention, the dispersion in latices and oil-in-water emulsification are particularly effective. These methods are well known in the art, and the technique of latex dispersion and the resulting advantages are described in Japanese Patent Application (OPI) Nos. 74538/75, 59943/76, and 32552/79, as well as Research Disclosure, No. 14850, pp. 77–79, August 1976.

Suitable latices include homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammonium methosulfate, sodium 3-(methacryloyloxy)propane-1-sulfonate, N-isopropyl acrylamide, N-{2-(2-methyl-4-oxopentyl)}acrylamide and 2-acrylamido-2-methylpropanesulfonic acid. The oil-in-water emulsification can be effected by any known method involving the dispersion of a hydrophobic additive such as couplers, and more specifically, the non-diffusing coupler described above may be dissolved in a high-boiling solvent, and the resulting solution is dispersed in a hydrophilic colloid such as gelatin so as to form microfine particles of the coupler.

The silver halide emulsion layers used in the present invention may consist of any of the known silver halides such as silver chloride, silver bromide, silver iodide, silver chlorobromide, silver iodobromide and silver chloroiodobromide. The silver halides may comprise coarse or fine grains, and their size may have a narrow or wide distribution. The crystals of these silver halide grains may be perfect or twinned, and the proportions of [100] and [111] planes may assume any value. The crystalline structure of these silver halide grains may be uniform throughout, or their interior may have a different phase than the surface. These silver halide grains may be of the type wherein a latent image is formed primarily on the surface, or of the type wherein the image is formed in the interior. These silver halide grains can be prepared by any of the techniques known in the art.

The silver halide photographic emulsion having the silver halide grains dispersed in a binder solution can be sensitized with a chemical sensitizer. The chemical sensitizers that can be used in the present invention are classified into four groups, noble metal sensitizers, sulfur sensitizers, selenium sensitizers and reduction sensitizers.

The silver halide photographic material according to the present invention may further contain other photographically useful addenta such as stabilizers, development accelerators, hardeners, surfactants, anti-stain agents, lubricants, and DIR substances.

According to the present invention, the brightening effect can be enhanced by the following procedure: the brightening agent and the compound capable of trapping this brightening agent are incorporated in different layers of the silver halide color photographic material, with the layer containing the compound to trap the brightener being positioned farther from the hydrophobic support than the layer containing the brightener; the silver halide color photographic material is then subjected to imagewise exposure and color development so as to diffuse the brightener into the layer containing the trapping compound. As a result, the brightener is trapped in said layer, so that not only the brightening effect is enhanced but also static defects such as static marks can be effectively prevented. While the exact mechanism by which these advantages are achieved in the present invention has not been unravelled, a plausible explanation would be as follows: (1) the incorporating the brightener and the compound capable of entrapping the brightener in separate layers decreases the chance of the development of static marks due to fluorescent light; (2) since the layer containing the compound capable of trapping the brightener is positioned farther from the hydrophobic support than the layer containing the brightener, the brightener, upon imagewise exposure and color development of the silver halide color photographic material, diffuses to be trapped in the layer containing the trapping compound, and this enhances the effectiveness of the brightener.

As will be understood from the following working examples, it was confirmed that the process of the present invention was reasonably effective in increasing the whiteness of the silver halide color photographic material and preventing the occurrence of static marks.

The following examples are given here for the mere purpose of illustrating the effectiveness of the process of the present invention to provide an enhanced brightening effect. It is to be understood that the scope of the present invention is by no means limited to these examples.

EXAMPLE 1

Three samples of the silver halide color photographic material according to the present invention were prepared by using the layer arrangements shown in Table 1. Four comparative samples were also prepared by using the layer arrangements also indicaed in Table 1.

TABLE 1

| | | Silver coating wt. (mg/dm$^2$) | Gelatin coating wt. (mg/dm$^2$) | Sample No. 1 | Sample No. 2 | Sample No. 3 | Comparative Sample No. 1 | Comparative Sample No. 2 | Comparative Sample No. 3 | Comparative Sample No. 4 |
|---|---|---|---|---|---|---|---|---|---|---|
| 6th layer | Protective layer | — | 15 | — | — | — | — | — | — | FB-1 |
| 5th layer | Red-sensitive layer | 3.0 | 20 | — | — | — | — | — | FB-1 | — |
| 4th layer | Intermediate layer | — | 15 | P-1 | — | P-1 | P-1 | P-1<br>FB-1 | P-1 | P-1 |
| 3th layer | green-sensitive layer | 3.0 | 20 | FB-1 | — | — | — | — | — | — |
| 2nd layer | Intermediate layer | — | 15 | — | FB-1 | — | — | — | — | — |
| 1st layer | Blue-sensitive layer | 4.0 | 20 | — | — | FB-1 | — | — | — | — |
| | | | Polyethylene-coated paper support | | | | | | | |

As shown above, the polyethylene-coated paper support was coated successively with the first to sixth layers containing silver halide and gelatin in the amounts indicated in the table. The fourth layer contained 0.55 mg/dm$^2$ of polyvinylpyrrolidone (wt.av.m.wt. 360,000, indicated by P-1 in Table 1) as the compound capable of trapping the brightening agent according to the present invention. One of the six layers contained 1 mg/dm$^2$ of the brightening agent FB-1. Comparative sample No. 1 did not contain FB-1.

The respective samples and comparative samples, without being exposed, were transported 50 times through an auto-printer (Sakura Color Printer 7N II produced by Konishiroku Photo Industry Co., Ltd.) at 25° C. and 20% R.H. at a rate of 8000 samples/hr. An adhesive tape (Eslon NO 360 of Sekisui Chemical Co., Ltd.) was attached to the emulsion layer side of each sample and then separated therefrom. The samples were subsequently subjected to color processing using processing solutions having the compositions shown below.

| Color processing step: | Temp. (°C.) | Time |
|---|---|---|
| Color development | 33 | 3 min 30 sec. |
| Bleach-fixing | 33 | 1 min 30 sec. |
| Washing with water | 33 | 3 min |
| Drying | 80 | |

| Color developer: | |
|---|---|
| Pure water | 700 ml |
| Benzyl alcohol | 15 ml |
| Diethylene glycol | 15 ml |
| Hydroxylamine sulfate | 2 g |
| N—Ethyl-N—β-methanesulfonamido-ethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2 g |
| Pure water to make 1,000 ml (pH 10.2) | |
| **Bleach-fixing solution:** | |
| Ethylenediaminetetraacetic acid ferric ammonium salt | 61 g |
| Ethylenediaminetetraacetic acid diammonium salt | 5 g |
| Ammonium thiosulfate | 125 g |
| Sodium metabisulfite | 13 g |
| Sodium sulfite | 2.7 g |
| Pure water to make 1,000 ml (pH 7.2) | |

The relative fluorescene intensities of the respective samples were determined by the following method. The samples were also checked for the occurrence of static marks. The results are shown in Table 2.

Determination of relative fluorescence intensities

The reflection densities of the developed samples were determined by a color analyzer (Model 607 of Hitachi, Ltd.), first without a filter, and a second time, with a color glass filter (UV-39 of TOSHIBA CORP.), positioned before the light source of the analyzer. The difference between the reflection density measured without a filter and that measured with a filter was referred to as the fluorescence intensity of each brightening agent at maximum fluorescence wavelength. The respective fluorescence intensities were indicated in terms of relative values, with the value for comparative sample No. 2 taken as 100.

TABLE 2

| Sample No. | | Fluorescence intensity | Occurrence of static marks: After transportation through printer | Occurrence of static marks: After peeling adhesive tape |
|---|---|---|---|---|
| The | 1 | 98 | none | a few |
| present invention | 2 | 98 | none | a few |
| | 3 | 97 | none | a few |
| comparative | 1 | 0 | none | none |
| | 2 | 100 | very many | very many |
| | 3 | 23 | none | a few |
| | 4 | 15 | none | a few |

As Table 2 shows, the samples of the color photographic material of the present invention provided higher fluorescence intensities after color processing than comparative sample 1 containing no brightener and comparative samples 3 and 4 wherein the brightener was incorporated in a layer more remote from the support than the layer containing the compound capable of trapping the brightener. In addition, the samples according to the present invention caused fewer static marks than comparative sample 2 having both the brightener and trapping compound incorporated in the same layer. It was therefore clear that the process of the present invention was very effective in achieving increased whiteness and preventing the occurrence of static marks.

EXAMPLE 2

Samples 4 and 5 of the silver halide color photographic material according to the present invention were prepared by using the layer arrangements shown in Table 3. Two comparative samples (Nos. 5 and 6) were also prepared by using the layer arrangements indicated in Table 3.

TABLE 3

| | | Silver coating wt. ($mg/dm^2$) | Gelatin coating wt. ($mg/dm^2$) | Sample No. 4 | Sample No. 5 | Comparative sample No. 5 | Comparative sample No. 6 |
|---|---|---|---|---|---|---|---|
| 7th layer | Protective layer | — | 15 | — | — | — | — |
| 6th layer | Intermediate layer | — | 15 | P-2 | P-2 | P-2 | P-2, FB-3 |
| 5th layer | Red-sensitive layer | 3.0 | 20 | — | — | — | — |
| 4th layer | Intermediate layer | — | 15 | FB-3 | — | — | — |
| 3th layer | Green-sensitive layer | 3.0 | 20 | — | — | — | — |
| 2nd layer | Intermediate layer | — | 15 | — | FB-3 | — | — |
| 1st layer | Blue-sensitive layer | 4.0 | 20 | — | — | — | — |
| | Polyethylene-coated paper support | | | | | | |

As shown above, the polyethylene-coated paper support was coated successively with the first to seventh layers containing silver halide and gelatin in the amounts indicated in the table. The sixth layer contained 0.55 $mg/dm^2$ of a vinylpyrrolidone/vinyl acetate (7:3) copolymer (wt. ave. m.wt. 220,000, indicated by P-2 in Table 3) as the compound capable of trapping the brightening agent according to the present invention. The second, fourth or sixth layer contained 1 $mg/dm^2$ of the brightening agent FB-3. Comparative sample No. 5 did not contain FB-3.

The respective samples and comparative samples, without being exposed, were transported through a printer and subjected to an adhesive tape peeling test by the same procedure and under the same conditions as used in Example 1. Subsequently, the samples were photographically processed as in Example 1 and checked for their relative fluorescence intensities, as well as the occurrence of static marks. The results are shown in Table 4.

TABLE 4

| Sample No. | | Fluorescence intensity | Occurrence of static marks: After transportation through printer | Occurrence of static marks: After peeling adhesive tape |
|---|---|---|---|---|
| The present invention | 4 | 99 | none | a few |
| | 5 | 99 | none | a few |
| Comparative | 5 | 0 | none | none |
| | 6 | 100 | very many | very many |

As Table 4 shows, the samples processed by the method of the present invention achieved high fluorescence intensities with extremely few static marks as compared with the comparative samples.

EXAMPLE 3

Samples 6 to 8 were prepared as in Example 1 except that FB-1 was replaced by FB-10, FB-2 or FB-5 which was incorporated in the second layer. The so prepared samples, without being exposed, were transported through a printer and subjected to an adhesive tape peeling test by the same procedure and under the same conditions as used in Example 1. Subsequently, the samples were photographically processed as in Example 1 and checked for their relative fluorescence intensities, as well as the occurrence of static marks. The results are shown in Table 5.

TABLE 5

| Sample No. | Fluorescence intensity | Occurrence of static marks: After transportation through printer | Occurrence of static marks: After peeling adhesive tape |
|---|---|---|---|
| 6 | 65 | a few | a few |
| 7 | 98 | none | a few |
| 8 | 99 | none | a few |

As Table 5 shows, the samples processed by the method of the present invention achieved high fluorescence intensities with extremely few static marks.

EXAMPLE 4

Three samples of silver halide color photographic material were prepared from the same formulations and by the same procedures used to prepare sample Nos. 1 to 3 in Example 1. The so prepared samples were subjected to imagewise exposure and subsequently processed as in Example 1. Images of high quality were produced without causing adverse effects on photographic properties such as sensitivity, gradation, fog and maximum color density.

EXAMPLE 5

Sample Nos. 9 to 11 and comparative sample Nos. 7 to 10 were prepared by using the layer arrangements specified in Table 6.

TABLE 6

| | | Coating wt. (mg/dm²): Silver | Trapping agent | UV absorber | Sample No. 9 | 10 | 11 | Comparative sample No. 7 | 8 | 9 | 10 |
|---|---|---|---|---|---|---|---|---|---|---|---|
| 6th layer | Protective layer | — | — | — | — | — | — | — | — | — | FB-1 1.0 |
| 5th layer | Red-sensitive layer | 3.0 | — | — | — | — | — | — | — | FB-1 1.0 | — |
| 4th layer | 2nd intermediate layer | — | (P-1) 0.55 | (UV-7) 6.0 | — | — | — | — | FB-1 1.0 | — | — |
| 3rd layer | Green-sensitive layer | 3.0 | — | — | FB-1 1.0 | — | — | — | — | — | — |
| 2nd layer | 1st intermediate layer | — | — | — | — | FB-1 1.0 | — | — | — | — | — |
| 1st layer | Blue-sensitive layer | 4.0 | — | — | — | — | FB-1 1.0 | — | — | — | — |
| | | Polyethylene-coated paper support | | | | | | | | | |

As shown above, the polyethylene-coated paper support was successively coated with the first to sixth layers including the silver halide emulsion layers containing silver in the amounts indicated in the table. The fourth layer contained 0.55 mg/dm² of polyvinylpyrrolidone (wt. av. mol. wt. 360,000, indicated by P-1 in Table 6) as trapping agent or the compound capable of trapping the brightening agent according to the present invention, as well as 6.0 mg/dm² of a UV absorber (UV-7). One of the six layers contained 1.0 mg/dm² of the brightening agent FB-1. Comparative sample No. 7 did not contain FB-1.

Sample Nos. 9 to 11 and comparative sample Nos. 7 to 10, without being exposed, were transported through a printer and subjected to an adhesive tape peeling test by the same procedure and under the same conditions as used in Example 1. Subsequently, the samples were photographically processed as in Example 1 and checked for their relative fluorescence intensitities, as well as the occurrence of static marks. The results are shown in Table 7.

TABLE 7

| Sample No. | | Fluorescence intensity | Occurrence of static marks: After transportation through printer | Occurrence of static marks: After peeling adhesive tape |
|---|---|---|---|---|
| The present invention | 9 | 98 | none | none |
| | 10 | 98 | none | none |
| | 11 | 97 | none | none |
| comparative | 7 | 0 | none | none |
| | 8 | 100 | very many | very many |
| | 9 | 23 | none | a few |
| | 10 | 15 | none | a few |

As Table 7 shows, the samples of the silver halide color photographic material of the present invention having the brightening agent incorporated in a layer below the 4th layer containing the UV absorber achieved higher fluorescence intensities with fewer static marks than the comparative samples. It was therefore clear that the process of the present invention was very effective in achieving increased whiteness and preventing the occurrence of static marks.

EXAMPLE 6

Sample Nos. 12 and 13, as well as comparative sample Nos. 11 to 14 were prepared by using the layer arrangements shown in Table 8.

TABLE 8

| | | Coating wt. ($mg/dm^2$) | | | Sample No. | | Comparative sample No. | | | |
|---|---|---|---|---|---|---|---|---|---|---|
| | | Silver | Brightener | UV absorber | 12 | 13 | 11 | 12 | 13 | 14 |
| 7th layer | Protective layer | — | — | — | — | P-2 0.55 | — | — | — | — |
| 6th layer | Intermediate layer | — | — | UV-7 4.0 | P-2 0.55 | — | — | — | — | — |
| 5th layer | Red-sensitive layer | 3.0 | — | — | — | — | — | — | — | P-2 0.55 |
| 4th layer | Intermediate layer | — | FB-3 1.0 | UV-7 4.0 | — | — | — | — | P-2 0.55 | — |
| 3rd layer | Green-sensitive layer | 3.0 | — | — | — | — | — | — | — | — |
| 2nd layer | Intermediate layer | — | — | — | — | — | — | P-2 0.55 | — | — |
| 1st layer | Blue-sensitive layer | 4.0 | — | — | — | — | — | — | — | — |
| | | Polyethylene-coated paper support | | | | | | | | |

As shown above, the polyethylene-coated paper support was successively coated with the first to seventh layers including the silver halide emulsion layers containing silver in the amounts indicated in the table. The fourth layer contained 1.0 $mg/dm^2$ of FB-3 as the brightener and 4.0 $mg/dm^2$ of UV-7 as the UV absorber. One of the layers 2 to 7 contained 0.55 $mg/dm^2$ of a vinylpyrrolidone/vinyl acetate (7:3) copolymer as the compound capable of trapping the brightener (said compound being indicated by P-2 in Table 8). Comparative sample No. 11 did not contain P-2.

Samples 12 and 13 and comparative samples 11 to 14, without being exposed, were transported through a printer and subjected to an adhesive tape peeling test by the same procedure and under the same conditions as used in Example 1. Subsequently, the samples were photographically processed as in Example 1 and checked for their relative fluorescence intensities, as well as the occurrence of static marks. The results are shown in Table 9.

TABLE 9

| Sample No. | | Fluorescence intensity | Occurrence of static marks: After transportation through printer | After peeling adhesive tape |
|---|---|---|---|---|
| The present invention | 12 | 97 | none | none |
| | 13 | 100 | none | none |
| Comparative | 11 | 0 | none | none |
| | 12 | 4 | none | none |
| | 13 | 5 | none | none |
| | 14 | 4 | none | none |

As Table 9 shows, the samples of the present invention achieved high fluorescence intensities with extremely few static marks.

EXAMPLE 7

Sample Nos. 14 to 16 of the silver halide color photographic material were prepared with the same layer arrangement of sample No. 10 except that FB-1 was replaced by FB-10, FB-2 or FB-5 which was incorporated in the second layer. The so prepared samples were transported through a printer and subjected to an adhesive tape peeling test by the same procedure and under the same conditions as used in Example 1. Subsequently, the samples were photographically processed as in Example 1 and checked for their fluorescence intensities, as well as the occurrence of static marks. The results are shown in Table 10.

TABLE 10

| Sample No. | Fluorescence intensity | Occurrence of static marks: After transportation through printer | After peeling adhesive tape |
|---|---|---|---|
| 14 | 65 | a few | a few |
| 15 | 98 | none | none |
| 16 | 99 | none | none |

As Table 10 shows, the samples of the present invention achieved high fluorescence intensities with extremely few static marks.

EXAMPLE 8

Sample No. 17 and comparative sample No. 15 were prepared using the layer arrangements shown in Table 11.

TABLE 11

| | | Coating wt. ($mg/dm^2$) | | Sample No. 17 | Comparative sample No. 15 |
|---|---|---|---|---|---|
| | | Silver | Trapping Agent | | |
| 7th layer | Protective | — | — | — | — |
| 6th layer | Intermediate layer | — | P-1 0.55 | UV-12 4.0 | UV-12 4.0 |
| 5th layer | Red-sensitive layer | 3.0 | — | — | — |
| 4th layer | Intermediate layer | — | — | FB-3 1.0 | — |
| 3rd layer | Green-sensitive layer | 3.0 | — | — | — |
| 2nd layer | Intermediate layer | — | — | — | — |
| 1st layer | Blue-sensitive layer | 4.0 | — | — | — |
| | | Polyethylene-coated paper support | | | |

As shown above, sample No. 17 had the same layer arrangement as used in Example 6 except that the 6th layer contained polyvinylpyrrolidone (trapping agent) the same as used in Example 5 and UV-12 (UV absorber) and the 3rd layer contained FB-3 (brightener).

Comparative sample No. 15 had the same layer arrangement as sample No. 17 except that FB-3 was not incorporated in the 3rd layer.

The so prepared sample No. 17 and comparative sample No. 15, as well as comparative sample No. 11 prepared in Example 6 were photographically processed as in Example 1 so as to check for their relative fluorescence intensities and the occurrence of static marks.

Another group of the samples was exposed to blue, green and red lights through respective optical wedges in a sensitometer (Model KS-7 of Konishiroku Photo Industry, Co., Ltd.), and subsequently processed as in Example 1. The relative spectral sensitivities of sample No. 17 and comparative sample No. 15 are shown in Table 12, with the values for comparative sample No. 11 taken as 100.

TABLE 12

| Sample No. | Relative spectral sensitivity Y | M | C | Relative fluorescence sensitivity | Occurrence of static marks: After transportation through printer | After peeling adhesive tape |
|---|---|---|---|---|---|---|
| Sample 17 | 98 | 100 | 100 | 100 | none | none |
| Comparative sample 15 | 98 | 100 | 100 | 0 | none | none |
| Comparative sample 11 | 100 | 100 | 100 | 0 | none | none |

As Table 12 shows, the silver halide photographic material of the present invention could prevent the occurrence of static marks and achieved increased whiteness in the unexposed area without causing any adverse effects on photographic properties such as sensitivity, gradation and fog.

The processed samples were held in a xenon fadeometer for 200 hours to see how the density of the yellow dye in each sample changed. The results are shown in Table 13.

TABLE 13

| | Yellow density |
|---|---|
| Sample No. 17 | 0.04 |
| Comparative sample No. 15 | 0.06 |
| Comparative sample No. 11 | 0.15 |

As Table 13 shows, the silver halide photographic material of the present invention was well protected against increased yellow staining.

What is claimed is:

1. A silver halide color photographic material having formed on a hydrophobic support at least one silver halide emulsion layer, a layer containing a brightening agent, a layer containing a compound that is capable of trapping the brightening agent, and at least one layer containing a UV absorber, said layer containing a compound capable of trapping the brightening agent being separate from the layer containing the brightening agent and positioned more remote from the support than the layer containing the brightening agent, the UV absorber layer being positioned more remote from the support than the silver halide emulsion layers and the layer containing the brightening agent, the compound capable of trapping the brightening agent being incorporated in at least one of the UV absorber containing layers or a layer that is more remote from the support than the most remote UV absorber containing layer.

2. A silver halide color photographic material according to claim 1, wherein said brightening agent is selected from a group consisting of diaminostilbene, benzidine, imidazole and imidazolone compounds.

3. A silver halide color photographic material according to claim 1, wherein said compound capable of trapping the brightening agent is a hydrophilic polymer.

4. A silver halide color photographic material according to claim 3, wherein said hydrophilic polymer is polyvinylpyrrolidone or polymer having vinylpyrrolidone as a repeating unit.

5. A silver halide color photographic material according to claim 3, wherein said hydrophilic polymer have a weight average molecular weight of 1,000 or greater.

6. A silver halide color photographic material according to claim 1, wherein said UV absorber is a benzotriazole compound represented by the following formula V:

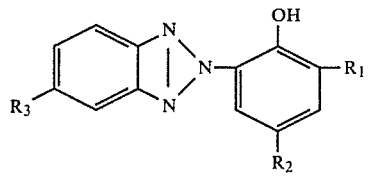

(V)

wherein $R_1$, $R_2$ and $R_3$ are each a hydrogen atom, a halogen atom, an alkyl group, an aryl group, an alkoxy group, an aryloxy group, an alkenyl group, a nitro group and a hydroxyl group.

7. A silver halide color photographic material according to claim 1, wherein said layer containing a brightening agent is deposited in an amount of 0.1 to 0.5 $mg/dm^2$ of a brightening agent.

8. A silver halide color photographic material according to claim 1, which further includes a protective layer.

9. A silver halide color photographic material according to claim 8, said layer containing a compound capable of trapping the brightening agent is positioned between the emulsion layer positioned the remotest from the support and the protective layer.

10. A silver halide color photographic material according to claim 1, which further includes a non-emulsion layer.

11. A silver halide color photographic material according to claim 10, wherein said layer containing a brightening agent is the non-emulsion layer that is positioned closer to the support than the UV absorber containing layer positioned the remotest from the support.

12. A silver halide color photographic material according to claim 1, wherein said support is a reflective support.

13. A method for providing enhanced brightening effect which comprises subjecting a novel silver halide color photographic material to imagewise exposure and color development so that said brightening agent is diffused into and trapped by the layer containing a compound capable of trapping the brightening agent, said silver halide color photographic material having formed on a hydrophobic support at least one silver halide emulsion layer, a layer containing a brightening agent, at least one layer containing a UV absorber, and a layer containing a compound that traps the brightening agent being separate from the layer containing the brightening agent and positioned more remote from the support than the layer containing the brightening agent, the UV absorber layer being positioned more remote from the support than the silver halide emulsion layers and the layer containing the brightening agent, the compound capable of trapping the brightening agent being incorporated in at least one of the UV absorber containing layers or a layer that is more remote from the support than the most remote UV absorber containing layer.

* * * * *